United States Patent [19]

Haass-Zöllick et al.

[11] Patent Number: 4,736,493

[45] Date of Patent: Apr. 12, 1988

[54] APPARATUS FOR SEPARATING WASTE FROM TEXTILE FIBER PROCESSING MACHINES

[75] Inventors: Klaus Haass-Zöllick, Wegberg; Ferdinand Leifeld, Kempen, both of Fed. Rep. of Germany

[73] Assignee: Trützschler GmbH & Co. KG, Monchen-Gladbach, Fed. Rep. of Germany

[21] Appl. No.: 929,841

[22] Filed: Nov. 13, 1986

[30] Foreign Application Priority Data

Nov. 13, 1985 [DE] Fed. Rep. of Germany ..... 3540259

[51] Int. Cl.[4] ..... D01G 1/00; D01G 15/82; B01D 46/26

[52] U.S. Cl. ..... 19/200; 19/205

[58] Field of Search ..... 19/205, 200

[56] References Cited

U.S. PATENT DOCUMENTS

| | | | |
|---|---|---|---|
| 2,166,925 | 7/1939 | Mitchell | 209/241 |
| 4,519,114 | 5/1985 | Rhyne | 19/205 X |
| 4,637,096 | 1/1987 | Wise | 19/205 X |

FOREIGN PATENT DOCUMENTS

| | | |
|---|---|---|
| 613087 | 6/1934 | Fed. Rep. of Germany . |
| 0867343 | 12/1952 | Fed. Rep. of Germany . |
| 0935424 | 10/1955 | Fed. Rep. of Germany . |
| 1004461 | 12/1959 | Fed. Rep. of Germany . |
| 1757339 | 4/1971 | Fed. Rep. of Germany . |
| 1931142 | 1/1979 | Fed. Rep. of Germany . |
| 2838173 | 3/1980 | Fed. Rep. of Germany . |
| 3006831 | 9/1981 | Fed. Rep. of Germany . |
| 0306604 | 7/1955 | Switzerland . |
| 0599995 | 6/1978 | Switzerland . |

*Primary Examiner*—Louis K. Rimrodt
*Attorney, Agent, or Firm*—Spencer & Frank

[57] ABSTRACT

An apparatus for separating fiber waste from an air stream includes a duct guiding a waste-laden air stream; and a stationary collecting vessel communicating with the duct for receiving the waste-laden air stream from the duct. The collecting vessel has a separating surface arranged for allowing passage of the air stream and retaining at least one part of the fiber waste within the collecting vessel. The fiber waste is removed downwardly from the collecting vessel. The collecting vessel is formed of a cylinder wall having a longitudinal axis oriented substantially horizontally; at least one portion of the cylinder wall constitutes the separating surface. The duct merges tangentially into the collecting vessel.

9 Claims, 2 Drawing Sheets

APPARATUS FOR SEPARATING WASTE FROM TEXTILE FIBER PROCESSING MACHINES

BACKGROUND OF THE INVENTION

This invention relates to an apparatus for separating fiber waste or similar impurities drawn away by suction from fiber processing machines, particularly cleaning machines and cards. The apparatus has a pneumatic conveyor duct which guides the waste-laden air stream into a stationary collecting vessel. The latter has a separating surface for retaining the waste within the collecting vessel, from which the waste may be removed in a downward direction.

A pre-separator (pre-filter) is known which is used for cleaning dust-laden air and which is installed in the de-dusting locations of cotton cleaning assemblies. Such a pre-separator also serves for separating waste in automatic systems for the intermittent waste removal from waste chambers of cotton cleaning machines and carding machines. The pre-separator is essentially a screen drum rotated by a drive motor. The retained fiber material is withdrawn by two cooperating rollers, one of which is provided with a thick foam rubber jacket to ensure that the removal side of the filter housing remains vacuum tight at the fiber outlet regardless of the thickness of the fiber material discharged by the rollers. The smaller of the two delivery rollers which serves as a doffer, is followed by an adjustable brush which cleans the wire mesh of the screen drum. The filter may be accessible through cleaning flaps in the zone of the screen drum underneath the brush and above the delivery rollers. The fiber material discharged by the delivery rollers falls into a waste carriage. In order to avoid damages to the filter, a sensor plate de-energizes the drive motor by means of a limit switch when the waste carriage is filled to capacity. The fiber waste may also be removed by suction and guided to a fiber compactor, a bale press or an installation which processes waste. The air which is filtered out by the screen drum and which still contains fine dust, is then guided to a fine filter through one, two or three pre-filters. It is a disadvantage of this known system that the rotary screen drum is structurally complex.

In another known apparatus, the separating surface is constituted by a planar stationary screening surface which is oriented at an angle of approximately 45° relative to the direction of the waste-laden air stream. It is a disadvantage of such an arrangement that a planar screening surface adversely affects the flow-dynamic properties of the air stream.

SUMMARY OF THE INVENTION

It is an object of the invention to provide an improved pre-separator of the above-outlined type from which the discussed disadvantages are eliminated, which is of particularly simple construction and which ameliorates flow-dynamic properties of the air stream.

This object and others to become apparent as the specification progresses, are accomplished by the invention, according to which, briefly stated, the stationary collecting vessel is a horizontally oriented cylinder whose wall surface is at least in part air-pervious and the pneumatic conveyor duct (supply duct) merges tangentially into the cylinder.

The pre-separator according to the invention is of simple construction permitting an economical manufacture. In the zone of separation no moving parts are present. Further, there are spatial advantages, particularly as concerns the combination of the pre-separator with an after-connected fine filter. The air charged with fiber tufts, waste or the like enters the separating zone tangentially and impinges upon an arcuate stationary separating surface. The material (fiber tufts, waste, etc.) which is deflected while the air with the dust passes through the air-pervious wall face, is removed downwardly by gravity. The arcuate shape of the separating zone is aerodynamically advantageous. In the start-up phase it may occur that the entire air of the initial stream does not pass through the filtering surface but one part of the air is deflected back, causing turbulences (vortices). By virtue of the arcuate configuration of the separating zone such turbulence does not adversely affect the separating process: on the contrary, the generated vortex leads to uniform sweeping currents which help the separating surfaces to remain free (unclogged).

According to an advantageous feature of the invention, the air-pervious wall is formed by a perforated sheet member, such as a screen. Advantageously, the air-pervious wall surface is a loosely secured woven material which may be movable and may be a nylon or metal fabric.

According to a further advantageous feature of the invention, a drum screen, functioning as a fine filter, is arranged downstream of the pre-separator, as viewed in the direction of material flow. Advantageously, the pre-separator and the drum filter are arranged in a single housing to which a suction device may be attached. Preferably, the pre-separator is arranged generally axially parallel with and adjacent to the drum filter. According to a further advantageous feature of the invention, the axis of the pre-separator is situated at a higher level than the axis of the drum filter. This arrangement enhances a removal of the waste downwardly by gravity.

According to a further feature of the invention, a module-like structure of the apparatus may be achieved by providing that with each drum set of the fine filter (post-filter, drum filter) there is connected a separate pre-separator with a discharge drive, by means of elastic shafts or Cardan shafts.

DESCRIPTION OF THE PREFERRED EMBODIMENTS

Figure 1:
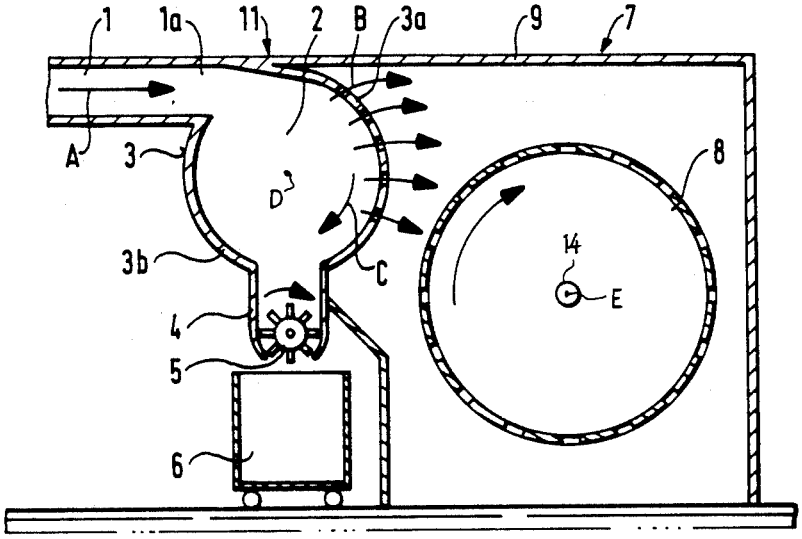
FIG. 1 is a schematic sectional side elevational view of a preferred embodiment of the invention.

Turning now to FIG. 1, the apparatus shown therein comprises a pneumatic delivery duct 1 whose upstream part is connected with waste chambers of a cotton cleaning installation, not shown. Air charged with fiber fly, dust and fiber waste flows in the duct 1 in the direction of the arrow A towards a pre-separator generally designated at 11. The delivery duct 1 merges tangentially into an upper part of a stationary collecting vessel 2 which forms part of the pre-separator 11 and which is a cylinder having a horizontally oriented longitudinal axis D. The collecting vessel 2 has a wall 3, one portion of which is formed as a sieve 3*a* generally facing the duct 1, while the other portion 3*b* is a continuous, air-impervious part. In the lower zone of the collecting vessel 2 the cylinder wall 3 is interrupted and communicates with a radially outwardly and downwardly extending discharge pipe 4 controlled by a star wheel gate 5. A movable waste carriage 6 may be positioned underneath the discharge pipe 4. Adjacent the collecting vessel 2 there is situated a fine filter generally designated at 7, including a rotary sieve drum 8 having an axis E coaxial with the drum drive shaft 14. The collecting vessel 2 and the fine filter 7 are accommodated in a common housing 9. The sieve drum 8 receives the air stream pre-filtered by the pre-separator 11. The air is removed from the inside of the drum by a suction device (not shown).

In operation, the air stream delivers material onto the sieve 3*a* of the pre-separator 2 in the direction of arrow A. One part of the air penetrates, together with dust particles, through the openings of the sieve 3*a*, as indicated by the arrows B, into the housing 9 where the dust is deposited on the outer face of the sieve drum 8. The other part of the air rotates in the direction of the arrow C within the collecting chamber 2 where heavy waste drops downwardly into the discharge pipe 4 and then into the waste carriage 6, as dispensed by the star wheel gate 5. The air stream C then sweeps the concave inner face of the wall part 3*b* and subsequently flows along the concave inner face of the screen 3*a*, enhancing the passage of dust-laden air.

Figure 2:
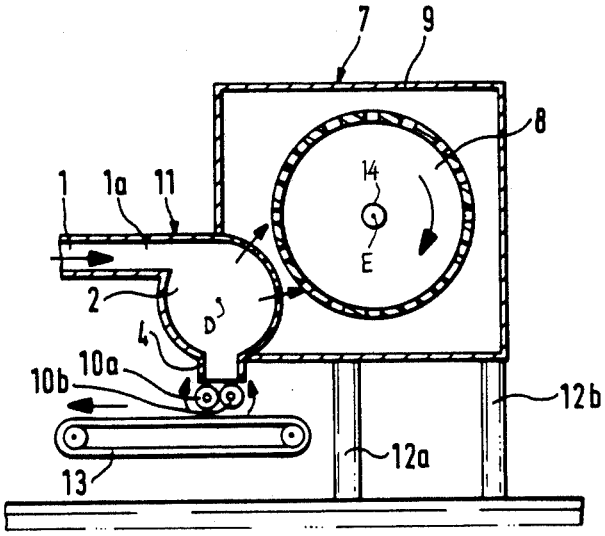
FIG. 2 is a schematic sectional side elevational view of another preferred embodiment of the invention.

Turning to the embodiment illustrated in FIG. 2, the longitudinal axis D of the cylindrical pre-separator 2 is situated at a level lower than that of the axis E of the sieve drum 8. The housing 9 is supported on posts 12*a* and 12*b*. At the outlet of the discharge pipe 4 delivery rollers 10*a* and 10*b* are arranged. Underneath the delivery rollers 10*a*, 10*b* there is situated a conveyor belt 13.

Figure 3:
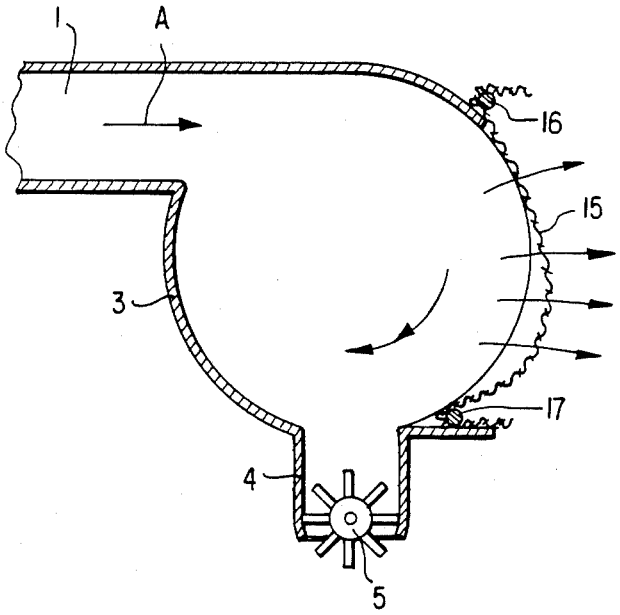
FIG. 3 is a cross-sectional view of still another preferred embodiment of the invention.
Figure 4:
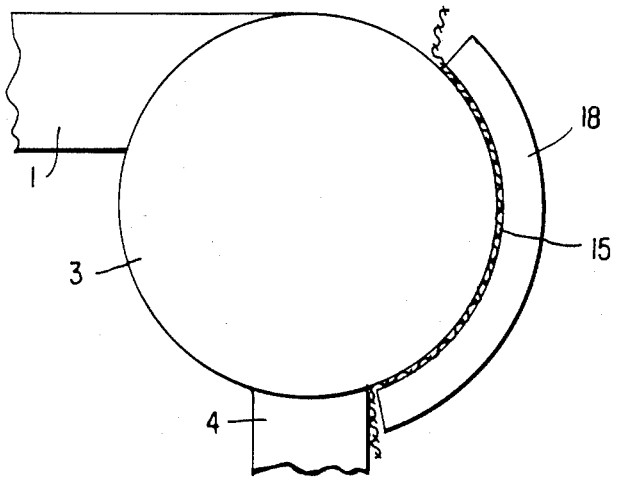
FIG. 4 is an end elevational view of FIG. 3.

Turning now to FIGS. 3 and 4, there is illustrated therein a further embodiment of the invention wherein the collecting vessel 2 has a pervious wall portion formed by a loosely held fabric 15 clamped to the vessel wall 3 by tightening members 16 and 17, as shown in FIG. 3. At the longitudinal end the loose fabric is held by shaped holding components 18 (only one visible in FIG. 4) which conform to the surface of the housing and clamp the longitudinal ends of the fabric thereto.

It will be understood that the above description of the present invention is susceptible to various modifications, changes and adaptations, and the same are intended to be comprehended within the meaning and range of equivalents of the appended claims.

What is claimed is:

1. An apparatus for separating fiber waste from an air stream, including a duct guiding a waste-laden air stream; a stationary collecting vessel communicating with said duct for receiving the waste-laden air stream from said duct; said collecting vessel having a separating surface arranged for allowing passage of the air stream and retaining at least one part of the fiber waste within said collecting vessel; and means for downwardly removing fiber waste from said collecting vessel; the improvement wherein said collecting vessel is formed of a cylinder wall having a longitudinal axis oriented substantially horizontally; said cylindrical wall defining a cylindrical vessel space free from moving parts; at least one portion of said cylinder wall constituting said separating surface; and said duct tangentially opening into said collecting vessel at an upper portion thereof in an orientation towards said separating surface.

2. An apparatus as defined in claim 1, wherein said separating surface is formed of a perforated sheet member.

3. An apparatus as defined in claim 1, wherein said separating surface is formed of a sieve.

4. An apparatus as defined in claim 1, wherein said separating surface is formed of a loosely supported fabric.

5. An apparatus as defined in claim 1, further comprising a drum filter arranged adjacent said collecting vessel and being arranged for receiving an air stream passing through said separating surface.

6. An apparatus as defined in claim 5, further comprising a common housing accommodating said collecting vessel and said drum filter.

7. An apparatus as defined in claim 5, wherein said collecting vessel and said filter drum are situated in a side-by-side relationship.

8. An apparatus as defined in claim 5, wherein said filter drum has a drum axis; the longitudinal axis of said cylinder wall is situated at a different height level than that of the drum axis.

9. An apparatus as defined in claim 8, wherein said longitudinal axis of said cylinder wall is situated at a level higher than that of the drum axis.

* * * * *